United States Patent [19]

Fresnel

[11] Patent Number: 4,600,371

[45] Date of Patent: Jul. 15, 1986

[54] APPARATUS FOR FITTING AND CENTERING THERMOPLASTIC SHEATH AROUND OBJECTS BY MEANS OF A VERTICAL UNIT WITH A FLOATING MANDREL

[76] Inventor: Jacques Fresnel, 15 Boulevard Lannes, 75116 Paris, France

[21] Appl. No.: 393,637

[22] Filed: Jun. 30, 1982

[30] Foreign Application Priority Data

Jul. 1, 1981 [FR] France ..... 81 12924

[51] Int. Cl.[4] ..... B65B 9/10; B29C 61/02

[52] U.S. Cl. ..... 425/110; 29/282; 53/563; 53/567; 425/393; 425/397

[58] Field of Search ..... 425/110, 150, 383, 392, 425/393, 174.4, 397, 384, 297; 53/567, 563; 29/271, 280, 282

[56] References Cited

U.S. PATENT DOCUMENTS

| | | | |
|---|---|---|---|
| 3,375,566 | 4/1968 | Sausik | 425/393 |
| 3,711,230 | 1/1973 | Magerle | 425/393 |
| 4,373,894 | 2/1983 | Peppel | 425/393 |

*Primary Examiner*—Willard E. Hoag
*Attorney, Agent, or Firm*—Browdy and Neimark

[57] ABSTRACT

An apparatus for fitting and centering a sheath such as a thermoplastic sleeve about an object comprises a vertically floating mandrel about which the sheath is fed downwardly toward the object which is to be sheathed. The mandrel is provided with a hollow passage in its lower portion to receive a normally vertically movable member, the vertically movable member carrying at its normally lower end a mold member adapted to engage the head of the object which is to be sheathed, so as to guide and center the transfer of the sheath to the object. The mandrel is provided with a recess opening inwardly from its exterior periphery and into communication with the hollow passage providing a first element lying in the recess and connected to the vertically movable member, so that movement imparted to the first element and causes movement of the vertically movable member, a second element, a drive means located exteriorly of the mandrel for driving the second element. The drive means is operable to move the second element from a location exterior of the mandrel into engagement with the first element, and for subsequently moving the second element while in engagement with the first element to cause lowering of the vertically movable member and the mold member carried by the vertically movable member from an initial elevated position, thereby causing the mold member to engage the head of the object which is to be sheathed.

9 Claims, 6 Drawing Figures

APPARATUS FOR FITTING AND CENTERING THERMOPLASTIC SHEATH AROUND OBJECTS BY MEANS OF A VERTICAL UNIT WITH A FLOATING MANDREL

FIELD OF THE INVENTION

This invention relates to the field of equipment intended for fitting lengths of sheath or sleeves coming from a flat heat-shrinkable plastic sheath around objects, such as receptacles and various containers. It especially relates to an apparatus of the floating mandrel type for fitting and centering sleeves in an automatic machine supplied with flat continuous heat-shinkable plastic sheath, which may or may not be printed.

BACKGROUND OF THE INVENTION

It is known that numerous operational stages are necessary, in the technique referred to above, to go from the thin heat-shrinkable plastic (for example polyvinyl chloride) sheet in the shape of a flat sheath or a continuous sheath, to the container provided with its covering which is, generally decorated.

Various machines have been described to automate these stages, as for example the machine which is the object of the European patent published under the No. 0,000,851 (application No. 78,400,045.7) corresponding to Fresnel U.S. Pat. No. 4,179,863 According to a particularly advantageous embodiment, the machine for fitting sleeves from a continuous thermoplastic sheath consists of a vertical unit with a floating mandrel provided with a narrowing or neck on its length where it is held by the cooperation of rollers and support wheels continuously to assure the following operations: widening of the flat continuous sheath coming from a supply on rollers, introduction onto the mandrel, downward transfer of the shaped sheath, cutting of the latter into lengths of sheath or sleeves of predetermined adequate length, depositing of the sleeves around containers to be covered and/or decorated (French patent application No. 80 20 301 of Sept. 22, 1980).

This unit with a floating mandrel is satisfactory and makes possible very high rates of fitting sleeves. However the reliability of a perfect transfer of the sheath (before cutting) onto the container is not total in a certain number of cases. For example, the container can be imperfectly centered under the mandrel. On the other hand, problems arise when the shape of the container is such that the distance between the base of the mandrel and the top of the body of the container is rather large (for example, a bottle with a neck); or again when the diameter of the container is greatest at the top (for example, the crimping of a can), which necessitates a maximum opening of the length of sheath when fitting and then causes difficulties for adjusting this length around the container with a slightly small diameter.

STATEMENT OF THE INVENTION

The invention has as its object elimination of said drawbacks and solving the delicate technical problem of assuring continuity between the mandrel and the container to be sheathed when the sheath descends on a container with said special shape. The invention further relates to assuring a very good centering of the container under the mandrel onto which the sheath is deposited.

To solve this problem, the invention proposes an improvement to the floating mandrel of known type comprising in its hollow lower part a movable part at the end of which is attached a mold intended to cap the head of the object to be sheathed. It is known, according to the patents mentioned above, that the movement of this part can be assured by means such as: a blowing of compressed air or alternatively by the use of electromagnets of extremely precise dimension, which results in a delicate operation lacking flexibility.

According to the apparatus of the invention, the operations of raising and lowering the movable part which carries the mold member are performed from outside of the mandrel during the lowering of the sheath by exclusively mechanical means.

In an advantageous arrangement of an embodiment of the apparatus, the movable part, inside the mandrel and ending with the mold outside the mandrel, consists of a spring-actuated rod provided with first elements, placed in an opening of the mandrel, suited to cooperate by contact with second elements driven from outside to move, at a predetermined rate, said first elements.

These elements inside and outside the mandrel with coordinated movements between them can coat various shapes. For example, shoes or similar objects whose surface has a low coefficient of friction can be provided. According to a particularly advantageous embodiment, each group of said elements consists of rollers or wheels which, on contact with a predetermined time, cause the sheath which surrounds the mandrel and the movable part and its mold to lower in such a way that the mold caps the container while assuring its centering.

The invention will be better understood by the detailed description of nonlimiting embodiments illustrated by the accompanying drawings which diagrammatically represent:

DESCRIPTION OF THE PREFERRED EMBODIMENT

Figure 1:
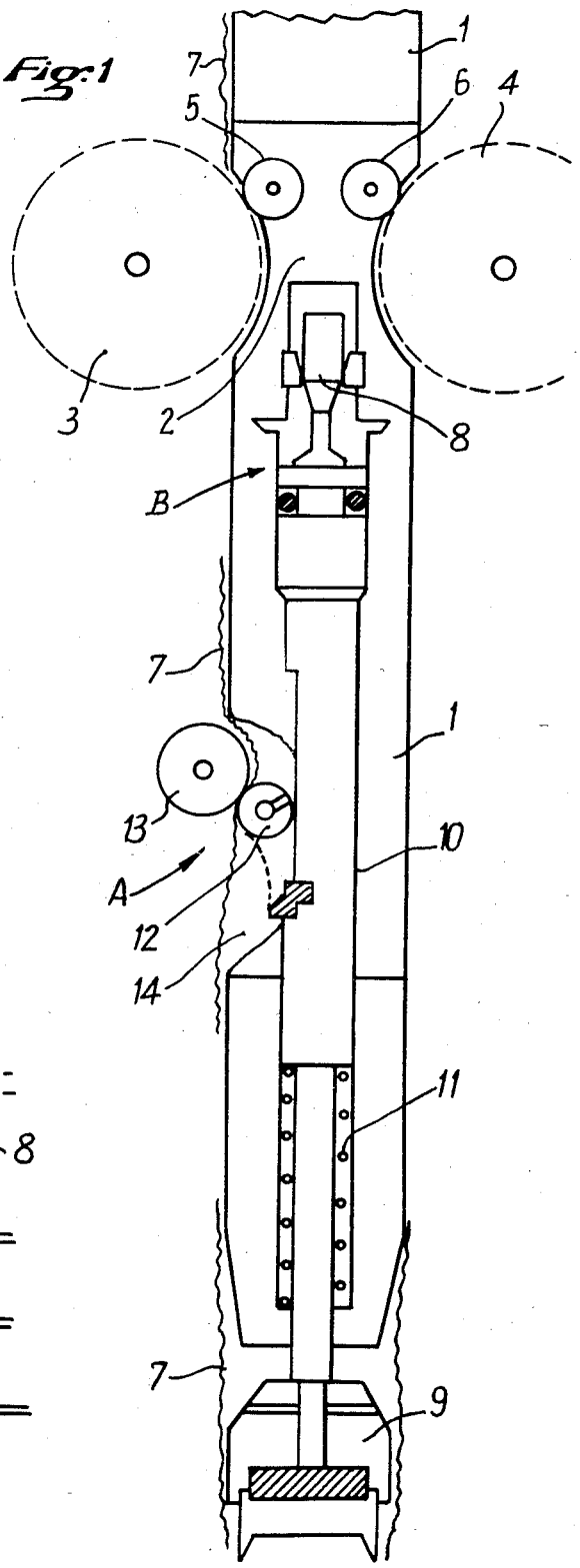
FIG. 1: a profile view, partially in section, of a floating mandrel provided with improvements according to the invention.

As represented in FIG. 1, the device is a main part of an automatic machine continuously fed with a flat sheath of heat-shrinkable plastic and intended to perform the successive operations of the opening sheath, transferring this sheath onto a cylindrical mandrel at a programmed speed, depositing and cutting the sheath in lengths or sleeves of predetermined length around the container to be sheathed, then heat-shrinking with a heating device mounted, for example, on a endless conveyor. The means for feeding the sheath and those for heat-shrinking can be, for example, those described in European patent No. 0,000,851 (corresponding to Fresnel U.S. Pat. No. 4,179,863).

Floating mandrel 1, whose middle and lower parts are seen in FIG. 1, is designed according to a known general principle described in French patent application No. 80.20301, and generally described below. At the interior of narrowing or neck 2, drive rollers 3 and 4 come in contact with counter-support rollers 5 and 6 and at the same time are used to keep mandrel 1 vertically supported and to carry thermoplastic sheath 7 downward. The part of the mandrel located under narrowing or neck 2 is hollow and provided with a movable part, for example here of piston type 8 at the lower end of which is fastened a hollow mold 9 intended to cap the head of the object to be sheathed (not shown). In said French patent application, the movement of this piston is controlled by induction by an electrostatic coil of slightly greater size than the mandrel.

According to the invention, the movable part is driven from outside the mandrel by purely mechanical means. In the case illustrated in FIGS. 1 to 4, rod 10 of the movable part, provided at its lower part with a spring-actuated sheath 11, has a pair of rollers 12 (only one is shown in FIG. 1) which cooperate, by a momentary contact, with small wheels 13 actuated from outside the mandrel, the mandrel having a recess 14 in the action zone of said rotating elements. Thus, the mandrel 1 remaining fixed in position during the work, the inner movable part is driven from the outside with its centering mold 9 in a downward movement, at a predetermined rate, automatically returning to the high position by the action of spring 11.

Figure 4:
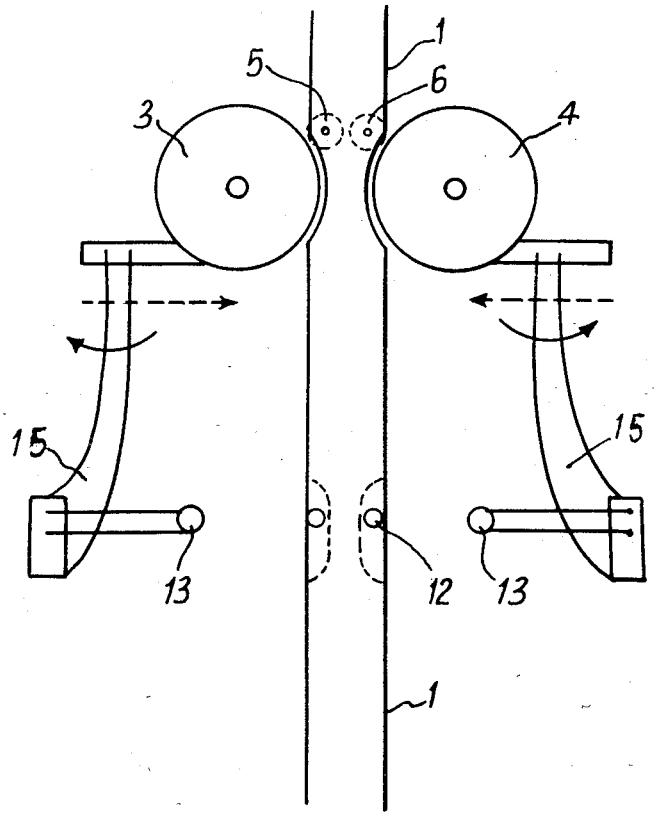
FIG. 4: the diagrammatic, profile representation of said part A indicating mechanical means outside the mandrel intended to drive the movable part which carries the mold.

As can be seen in very diagrammatic FIG. 4, small wheels 13 are held by support arms 15 which, as a result of an associated device provided with a cam not represented here, perform a "square" movement having the following phases: horizontal approach of the mandrel until contact of small wheels 13 and rollers 12, lowering along the mandrel while 13 presses on 12 (sheath 7 passing these two rollers), then horizontal separation of arms 15 to allow mold 9 to rise on the base of mandrel 1 by the action of spring 11 and, finally, rising of support arms 15; the cycle beginning again as described above. The distance or separation value of arms 15 is adjustable as a function of the diameter of the mandrel, and the length of lowering the arms along the mandrel corresponds to the distance between the head and the body of the container to be sheathed.

In practice, the movement of mold 9 beneath the base of mandrel 1 is done just before the starting of the lowering of sheath 7 on the mandrel. Once this lowering is started, the container under the mold is capped with the sheath, support arms 15 are separated and under the action of spring 11, the mold moves upwardly toward the mandrel.

When mold 9 is capped on the container to be sheathed, it must remain a certain time in this position to allow the sheath to pass the critical point in its descent along the container. This critical point can correspond, for example, to the distance between the head and the body of the container or again to a particular shape of the top of the container (the crimping of a can . . . etc.) The cutting of the sheath in lengths or sleeves by a device already known in itself and not shown is done when the sheath has arrived at the bottom of the container.

Figure 3:
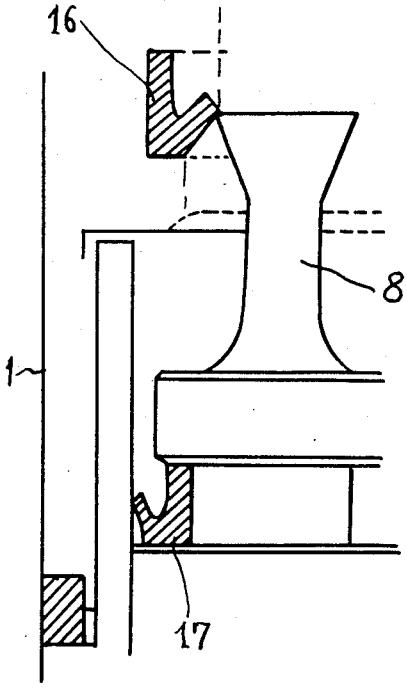
FIG. 3: an enlarged, detailed view of area B of FIG. 1

In this example of embodiment, the time lag of the movable part inside the mandrel is assured, at piston 8, by a double set of lipped joints 16 and 17—clearly visible in FIG. 3—which oppose the immediate rise of rod 10 when mold 9 is in a time-delayed position capping the container to be sheathed. This joint device can be replaced by a system with an equivalent function, as for example, a counterweight with screw pitch.

Other embodiments and variants enter into the context of the general process of the invention and will be briefly described below.

Figure 2:
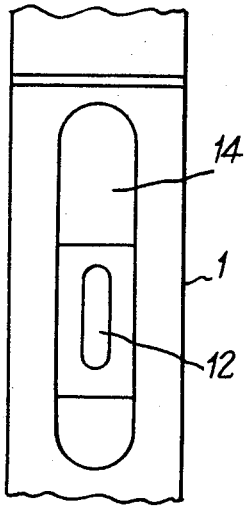
FIG. 2: an enlarged, front view of part A of FIG. 1

To begin with, in the device in FIGS. 1 and 2, it is possible to use a single series of roller 12 and small wheel 13 and a single support arm 15, the unit being thus arranged on a single side of floating mandrel 1.

Figure 5:
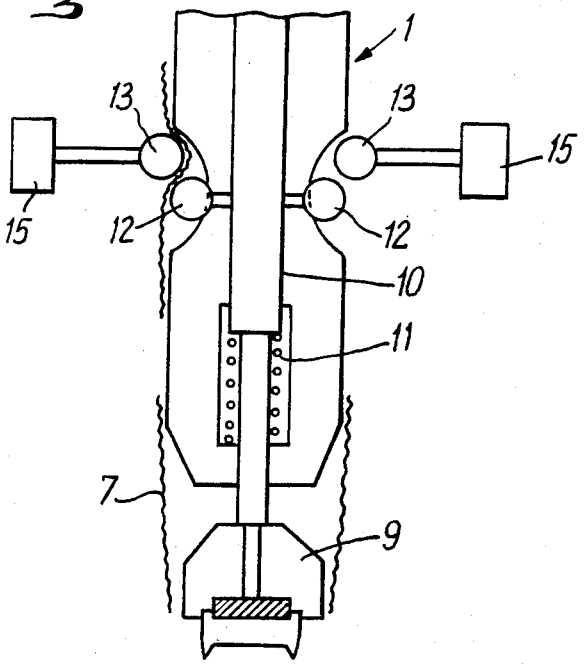
FIGS. 5 and 6: different variants of embodiment of the middle and lower parts of the device in FIG. 1.

Moreover, support art 15 cannot pivot and separate from mandrel 1 during the rise of mold 9. In this case, small wheel 13 remains permanently pressed against roller 12 not only during the lowering of the sleeve, but also during the rise of mold 9. In such an operation, it is the force of spring 11 which makes it possible to maintain contact between 12 and 13. In this operational variant, it is also possible to provide either a single roller/-small wheel couple—the roller being connected to the support arm—this on only one side of the floating mandrel, or two couples, with one couple placed on each side of this mandrel. This embodiment is illustrated in FIG. 5.

Figure 6:
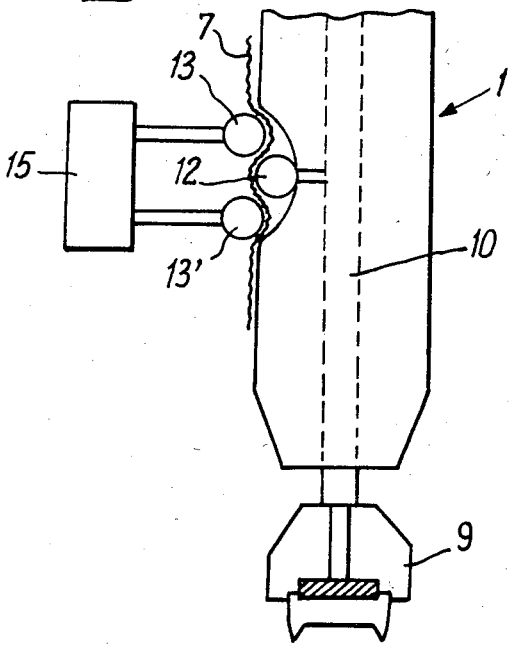

According to another particularly advantageous variant illustrated in FIG. 6, support arm 15 can be connected not only to a single small wheel 13, but also to two small wheels, high and low, numbered 13 and 13' which hold inside roller 12, upper small wheel 13 assuring the lowering of the sleeve while lower small wheel 13' assures the rise of the mold or cap after depositing of the sleeve on the container. In this embodiment, return spring 11 of mold 9 can be eliminated and a series of double small wheels and roller can be provided either on a single side of the mandrel (as in FIG. 6) or on two opposite sides on the same horizontal plane. Elimination of the spring makes it possible to eliminate any phenomenon of inertia and mold 9 can remain in contact on the top of the container as long as desired, this time being determined by the cam mentioned above whose profile is suitable for keeping the mold on the container for a predetermined sequential period. Moreover, device 8 in FIG. 1 for the time lag of the movable part of the mandrel, is than no longer necessary.

Finally, according to still another variant of the device shown diagrammatically in FIG. 1, said systems of support arms/rollers/small wheels can be placed not only under the group of rollers (designated 3-4; 5-6) which are used to keep mandrel 1 vertically supported, but also above this group.

I claim:

1. In an apparatus for fitting and centering a sheath such as a thermoplastic sleeve or the like about an object and comprising a vertically floating mandrel about which the sheath is fed downwardly toward the object, and in which said mandrel is provided with a hollow passage in the lower portion thereof to receive a normally vertically movable member, said vertically movable member carrying at the normally lower end thereof a mold member adapted to engage the head of the object which is to be sheathed, whereby to guide and center the transfer of said sheath to said object, in which the improvement comprises providing a recess in said mandrel opening inwardly from the exterior periphery of said mandrel and into communication with said hollow passage, providing a first element lying in said recess and connected to said vertically movable member, whereby movement imparted to said first element causes movement of said vertically movable member, a second element, a drive means located exteriorly of said mandrel for driving said second element, said drive means being operable to move said second element from a location exterior of said mandrel into engagement with said first element, and for subsequently moving said second element while in engagement with said first element to cause lowering movement of said vertically movable member and of said mold member carried by said vertically movable member from an initial elevated position, whereby to cause said mold member to engage the head of the object which is to be sheathed.

2. An apparatus as defined in claim 1 comprising spring means engageable with said vertically movable member, said spring means being operable to return said vertically movable member and said mold member carried thereby to said vertical elevated position after the expiration of a predetermined interval.

3. An apparatus as defined in claim 1 comprising at least one first element lying in said recess of said mandrel and connected to said vertically movable member, each of said first elements comprising a roller, said second element comprising at least one small wheel which is engageable with said roller.

4. An apparatus as defined in claim 1 in which said second element is mounted on a support arm, said support arm being movable by said drive means toward said mandrel to cause said second element to engage said first element, and for subsequently moving said second element while in engagement with said first element to cause said lowering movement of said vertically movable member and of said mold member carried by said vertically movable member from said initial elevated position.

5. An apparatus as defined in claim 4 in which both said first and said second elements are rotary members.

6. An apparatus as defined in claim 5 in which said support arm supports two small rotary members which respectively engage oppositely disposed peripheral portions of said first element.

7. An apparatus as defined in claim 6 comprising support means for said vertically floating mandrel, and in which the unit comprising said support arm, said two small rotary members supported by said support arm, and the rotary member defining said first element, is mounted on a single side of said mandrel.

8. An apparatus as defined in claim 7 in which said unit comprising said support arm, said two small rotary members supported by said support arm, and the rotary member defining said first element, is mounted above said support means for said vertically floating mandrel.

9. An apparatus as defined in claim 7 in which said unit comprising said support arm, said two small rotary members supported by said support arm, and the rotary member defining said first element, is mounted below said support means for said vertically floating mandrel.

* * * * *